US005213491A

United States Patent [19]

Fujiwara et al.

[11] Patent Number: 5,213,491

[45] Date of Patent: May 25, 1993

[54] TANDEM PUMP HAVING A DIFFERENT SIZED VANE FOR EACH PUMP

[75] Inventors: Hidetoshi Fujiwara, Aichi; Mitsunori Naruse, Okazaki, both of Japan

[73] Assignee: Toyoda Koki Kabushiki Kaisha, Kariya, Japan

[21] Appl. No.: 837,115

[22] Filed: Feb. 18, 1992

[30] Foreign Application Priority Data

Feb. 19, 1991 [JP] Japan ..... 3-024585

[51] Int. Cl.[5] ..... F04C 2/344; F04C 11/00

[52] U.S. Cl. ..... 418/82; 418/133; 418/212; 418/268

[58] Field of Search ..... 418/82, 132, 133, 212, 418/267-269

[56] References Cited

U.S. PATENT DOCUMENTS 2,642,802 6/1953 Gardiner ..... 418/133
4,415,319 11/1983 Masuda et al. ..... 418/212
4,523,897 6/1985 Lower et al. ..... 418/13
4,971,535 11/1990 Okada et al . ..... 418/133

FOREIGN PATENT DOCUMENTS 4110392 10/1991 Fed. Rep. of Germany .
2102888 2/1983 United Kingdom .

*Primary Examiner*—John J. Vrablik
*Attorney, Agent, or Firm*—Oblon, Spivak, McClelland, Maier & Neustadt

[57] ABSTRACT

An improved tandem pump operates satisfactorily even at low temperatures. The pump has a pump housing, a first rotor, plural first vanes held by the first rotor, a second rotor, and plural second vanes held by the second rotor. A first cam ring, an intermediate side plate, and a second cam ring are disposed side by side to constitute first and second pump chambers in the housing. The side plate is split into plural parts. Oil delivered by rotation of the first rotor is forced into a pressure chamber formed between the plural parts of the intermediate side plate. The portion of the inner end surface of each first vane which receives pressure is made smaller in area than the portion of the inner end surface of each second vane which receives pressure.

4 Claims, 5 Drawing Sheets

TANDEM PUMP HAVING A DIFFERENT SIZED VANE FOR EACH PUMP

FIELD OF THE INVENTION

The present invention relates to a tandem pump having two rotors rotatably mounted in pump housings.

BACKGROUND OF THE INVENTION

In a tandem pump, an intermediate side plate is disposed between two rotors. Reducing the gaps between each rotor and the side plate to reduce the flow rate of oil leaking through these gaps is important to enhance the volumetric efficiency. Therefore, in a known structure, the intermediate side plate is divided into two side plate portions so that a pressure chamber is formed between them. Oil delivered by rotation of one rotor is introduced into this pressure chamber to resiliently deform the side plate portions toward their respective opposite rotors, thus narrowing the aforementioned gaps.

In this conventional tandem pump, the grooves formed in the rotors for receiving vanes are made uniformly in width so that the pumps produce pressure equally at the beginning of rotation. However, the widths of the grooves are not uniform due to machining error. Consequently, when the pump is started, the vanes of the rotor in the first pump chamber may come out earlier than the vanes of the rotor in the second pump chamber. This phenomenon becomes conspicuous at low temperatures where the viscosity of the working oil is large. If such a phenomenon takes place, the pressure of the oil admitted into the pressure chamber causes the side plate portion opposite to the rotor inside the second pump chamber to deflect excessively toward the rotor because the pressure inside the second pump chamber is low. The gap between the rotor and the side plate portion is then lost. As a result, a sufficient flow of lubricating oil fails to be supplied. Hence a seizure occurs.

SUMMARY OF THE INVENTION

The above problem is solved in accordance with the teachings of the invention by a tandem pump comprising a pump housing, a plurality of first vanes, a first rotor, a plurality of second vanes, and a second rotor. A first cam ring, an intermediate side plate, and a second cam ring are disposed side by side in this order and fitted in the pump housing. The first cam ring has a cam surface on the inside. One end of each first vane makes a sliding contact with this cam surface. The first vanes are radially slidably held by the first rotor. The second cam ring has a cam surface on the inside. One end of each second vane makes a sliding contact with this cam surface. The second vanes are radially slidably held by the second rotor. The intermediate side plate is split into plural portions. A pressure chamber is formed between the adjacent portions of the intermediate side plate. Oil delivered by rotation of the first rotor is fed to the pressure chamber. The inner end surface of each first vane which receives pressure is set smaller in area than that of the inner end surface of each second vane which receives pressure.

With respect to each vane held to its rotor, as the pressure-receiving area of the inner end surface increases, the area of the portion receiving pressure from the back pressure chamber located behind the vane increases. Also, a larger centrifugal force is produced during rotation of the rotor and so the vane is more likely to come out.

The inner end surface of each first vane which receives pressure is set smaller in area than that of the inner end portion of each second vane which receives pressure. During rotation of the rotors, the second vanes come out earlier than the first vanes at all times. A pumping action occurs inside the second pump chamber earlier than the first pump chamber. The oil delivered by the first rotor resiliently deforms the side plate portions toward their opposite rotors. At this time, the side plate portions are prevented from deflecting excessively toward the second rotor.

Other objects and features of the invention will appear in the course of the description thereof which follows.

DETAILED DESCRIPTION OF THE INVENTION

Figure 1:
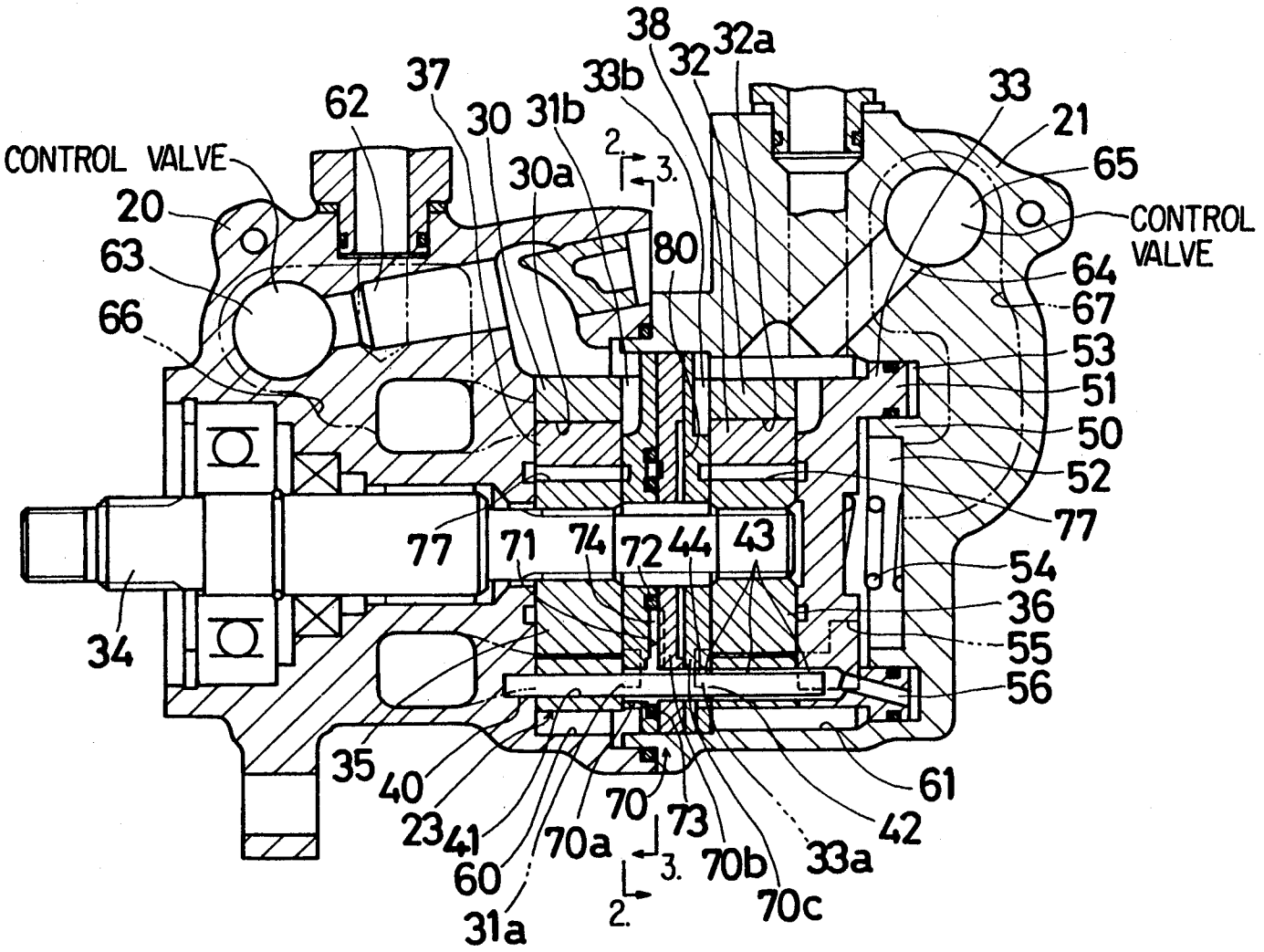
FIG. 1 is a cross-sectional view of a tandem pump according to the invention.

Referring to FIG. 1, there is shown a tandem pump embodying the concept of the present invention. This pump comprises a first pump housing 20 and a second pump housing 21 connected to the first pump housing 20. A hollow chamber 23 of a circular cross section is formed in the first and second housings 20, 21. A first cam ring 30, an intermediate side plate 70, a second cam ring 32, and a rear side plate 33 are disposed side by side in this order and fitted in the chamber 23 so as to constitute first and second pump chambers.

Figure 4:
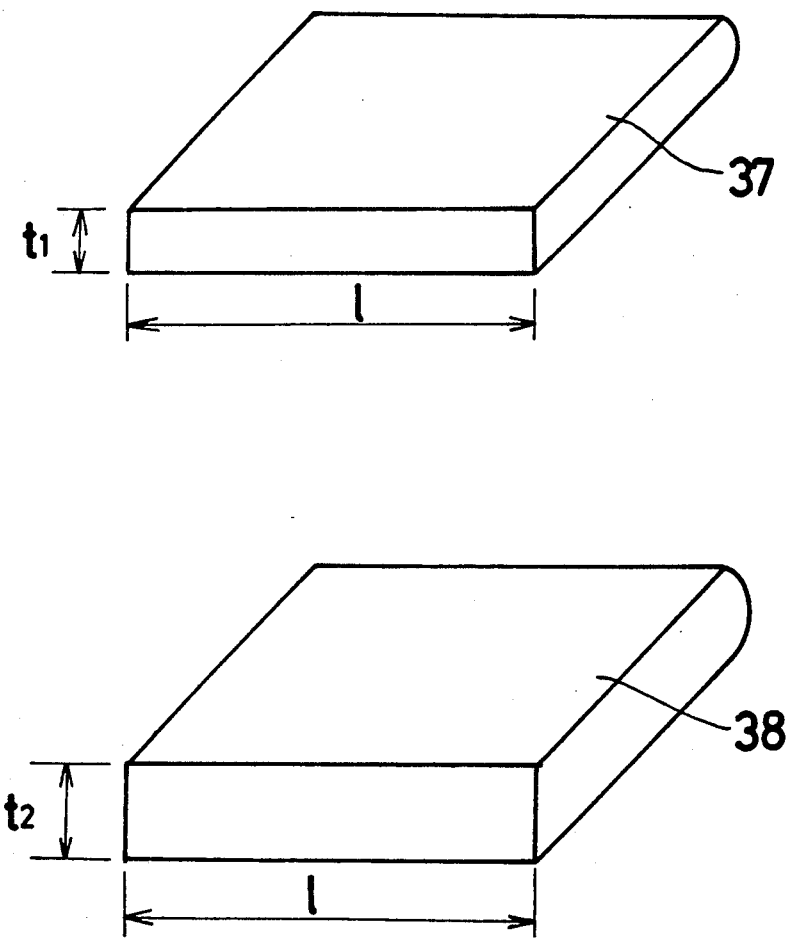
FIG. 4 is a perspective view of one of the first vanes of the pump shown in FIG. 1 and one of the second vanes of the pump, for illustrating their thicknesses, i.e., dimensions taken in the direction of rotation.

A rotating shaft 34 is held by the first pump housing 20 so as to be rotatable about the centers of the first and second cam rings 30, 32. A first rotor 35 is splined to this shaft 34 at a position corresponding to the first cam ring 30. A second rotor 36 is splined to the shaft 34 at a position corresponding to the second cam ring 32. The first rotor 35 is provided with grooves radially regularly spaced from each other. First vanes 37 having a thickness of $t_1$ are slidably held in these grooves. Similarly, the second rotor 36 is formed with radially equally spaced grooves such that second vanes 38 having a thickness of $t_2$ are slidably held in these grooves. One of the first vanes 37 and one of the second vanes 38 are shown in FIG. 4. Their dimensions taken parallel to the rotating shaft 34, or width l, are identical, but the thickness $t_2$ of the second vanes 38, or the dimension taken in the direction of rotation, is larger than the thickness $t_1$ of the first vanes 37 by a given amount $\Delta t$. An egg-shaped inner cam surface 30*a* with which one end of each first vane 37 makes a sliding contact is formed on the inner surface of the first cam ring 30. Likewise, an egg-shaped inner cam surface 32*a* with which one end of each second vane 38 makes a sliding contact is formed on the inner surface of the second cam ring 32.

Figure 2:
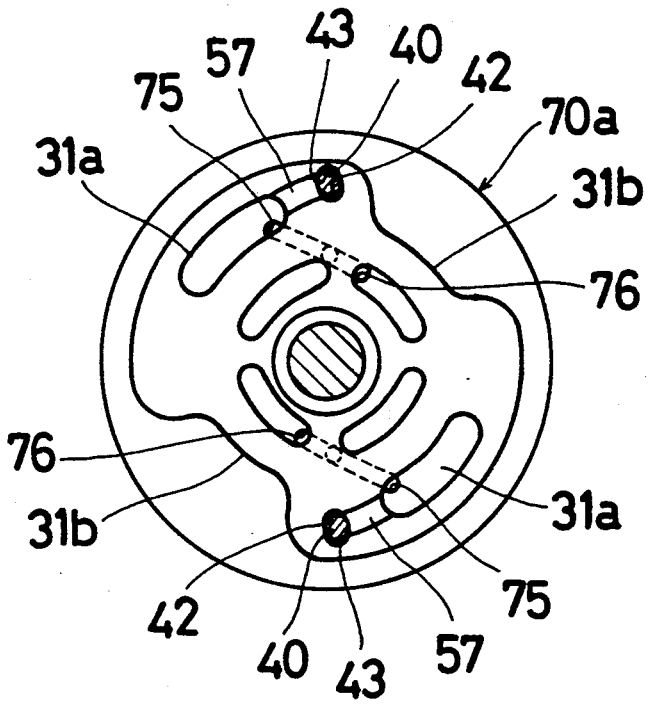
FIG. 2 is a cross-sectional view taken on line 2—2 of FIG. 1.

An intermediate side plate 70 is composed of a first side plate 70*a*, a second side plate 70*b*, and a third side plate 70*c*. As shown in FIG. 2, discharge ports 31*a* and intake ports 31*b* are formed in the end surface of the first side plate 70*a* which is located on the side of the first rotor 35. Discharge ports 33*a* and intake ports 33*b* are formed in the end surface of the third side plate 70*c* that is on the side of the second rotor 36. Similarly, discharge ports 33*a* and intake ports 33*b* are formed in the end surface of the rear side plate 33 that is located on the side of the second rotor 36.

Figure 3:
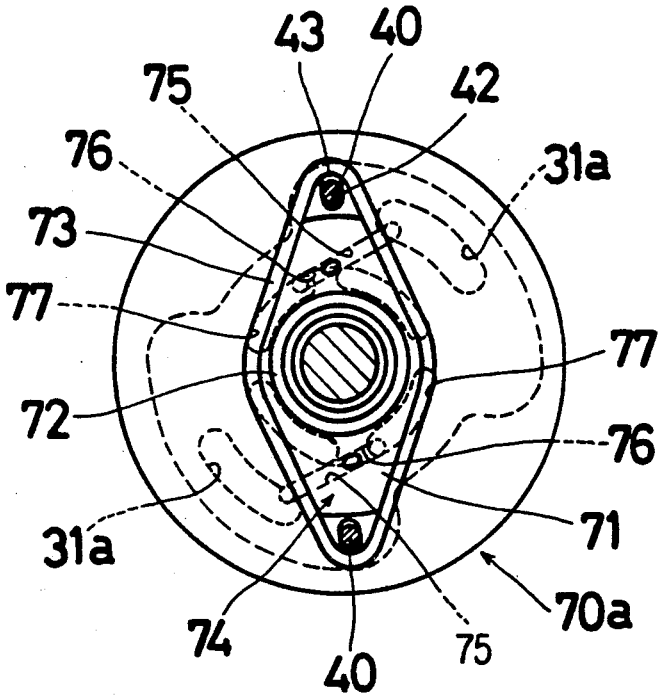
FIG. 3 is a cross-sectional view taken on line 3—3 of FIG. 1.

A recess 71 is formed on the surface of the first side plate 70*a* which faces the second side plate 70*b*. As shown in FIG. 3, this recess 71 is substantially rhombic. The outer and inner surfaces of the recess 71 are sealed by O rings 72 and 73, respectively, to form a pressure chamber 74. This chamber 74 is in communication with the discharge ports 31*a* formed on the side of the first rotor 35 via holes 75 extending through the first side plate 70*a*. The holes 75 are inclined to both side surfaces of the first side plate 70*a*. The pressure chamber 74 is also in communication with back pressure chambers 77 via holes 76 extending obliquely through the first side plate 70*a*. The back pressure chambers 77 are formed behind the vanes of the first rotor 35.

A clearance 80 is formed in the surface of the second side plate 70*b* which faces the third side plate 70*c*. This clearance 80 takes an egg-shaped form, in the same way as the cam surface formed in the inner surface of the cam ring 32. This clearance 80 absorbs the flexure of the second side plate 70*b* toward the third side plate 70*c*.

Two pins 40 are fitted into the first pump housing 20 parallel to the rotating shaft 34 and fixed there. The first cam ring 30 has holes 41. The intermediate side plate 70, the second cam ring 32, and the rear side plate 33 have holes 42, respectively. The pins 40 extend through these holes 41 and 42 to place the cam rings 30 and 32 in phase with the first pump housing 20. The holes 42 are of an elliptical cross section. A gap 43 is formed between each hole 42 and the outer surface of each pin 40. One of the gaps 43 acts as a first communication passage 44 which places the discharge ports 31*a* on the side of the first rotor 35 in communication with a second working chamber 53 (described later).

A cylindrical protrusion 50 is formed on the end surface of the second pump housing 21 which is located on the side of the rear side plate 33. A protrusion 51 which fits over the outer surface of the protrusion 50 is formed on the end surface of the rear side plate 33 that faces the protrusion 50. The space between the second pump housing 21 and the rear side plate 33 is partitioned into a first working chamber 52 and the aforementioned second working chamber 53 by these protrusions 50 and 51. A spring 54 for pushing the rear side plate 33 toward the second rotor 36 is inserted in the first working chamber 52. A second communication passage 55 which is in communication with the discharge ports 33*a* formed on the side of the second rotor 36 opens into the first working chamber 52. The second working chamber 53 is in communication with the first communication passage 44 by way of a third communication passage 56 in the rear side plate 33.

The oil delivered from the discharge ports 31*a* is forced into the second working chamber 53 via a communication groove 57 (FIG. 2), the first communication passage 44, and the third communication passage 56. The oil delivered from the discharge ports 33*a* is directed into the first working chamber 52 via the second communication passage 55. As a result, the rear side plate 33 is pushed toward the second cam ring 32 by the pressure of the oil forced into the first and second working chambers 52, 53.

A first annular groove 60 which is in communication with the intake ports 31*b* is formed on the periphery of the first cam ring 30 that is located inside the hollow chamber 23. A second annular groove 61 that is in communication with the intake ports 33*b* is formed on the periphery of the second cam ring 32 which is located inside the hollow chamber 23. The first annular groove 60 is in communication with a first flow control valve 63 via an intake passage 62, the valve 63 being mounted in the first pump housing 20. The second annular groove 61 is in communication with a second flow control valve 65 via an intake passage 64, the valve 65 being mounted in the second pump housing 21. The discharge ports 31*a* are in communication with the first flow control valve 63 via a discharge passage 66. The discharge ports 33*a* are in communication with the second flow control valve 65 via a discharge passage 67. The flow rate of the expelled oil is controlled by the control valves 63 and 65 of a known construction.

The operation of the tandem pump of the construction described above is next described. When the rotating shaft 34 is rotated, the first rotor 35 and the second rotor 36 are rotated. At this time, the first vanes 37 of the first rotor 35 are moved radially along the inner cam surface 30*a*, and the second vanes 38 of the second rotor 36 are moved radially along the inner cam surface 32*a*. This increases or decreases the volumes of the pump chambers defined by the inner cam surfaces 30*a*, 32*a* and the vanes 37, 38. Oil is admitted from the intake ports 31*b* and 33*b*. Concurrently, oil is discharged from the discharge ports 31*a* and 33*a*. The oil delivered from the discharge ports 31*a* is sent to a hydraulic machine (not shown) via the discharge passage 66 and the first flow control valve 63. The oil delivered from the discharge ports 33*a* is forced into another hydraulic machine (not shown) via the discharge passage 67 and the second flow control valve 65.

The oil delivered from the discharge ports 31*a* connected with the first rotor 35 is forced into the pressure chamber 74 via the hole 75, thereby pushing the first side plate 70*a* toward the first cam ring 30. The first side plate 70*a* is resiliently deformed. The second side plate 70*b* is pushed toward the second cam ring 32 and resiliently deformed. The flexure of the second side plate 70*b* toward the second cam ring 32 is absorbed by the clearance 80 formed in the surface of the second side plate 70*b* which faces the third side plate 70*c*. Hence the second rotor 36 is not affected.

However, at low temperatures the viscosity of the working oil is large. In this case, the second vanes 38 on the second rotor 36 may not come out, and pumping action may not occur. If so, the flexure of the second side plate 70*b* cannot be fully absorbed by the clearance 80, because the pressure inside the pumping chamber on the side of the second rotor 36 is low. The flexure affects the second rotor 36 via the third side plate 70*c*, narrowing the gap between the second rotor 36 and the third side plate 70*c*. As a result, a sufficient amount of lubricating oil is not supplied, thus giving rise to a seizure.

The theory underlying the inventive concept is as follows. As the thickness of the vanes of vane pumps increases, the area subjected to the pressure inside the back pressure chamber located behind the vanes increases. Also, when the rotor turns, a larger centrifugal force is produced. Hence, the vanes are more likely to come out. In particular, the thickness of the first vanes 37 of the first rotor 35 is set smaller than that of the second vanes 38 of the second rotor 36 so that the second vanes 38 may come out earlier than the first vanes 37 at all times. The second pump chamber in which the second rotor rotates produces a pumping action earlier than the first pump chamber in which the first rotor 35 rotates. This prevents the third plate 70*c* which faces the second rotor 36 at low temperatures from being deformed to a great extent toward the second rotor 36. That is, any excessive flexure is prevented and thus the gap is prevented from being lost. In consequence, seizure is prevented.

Figure 5:
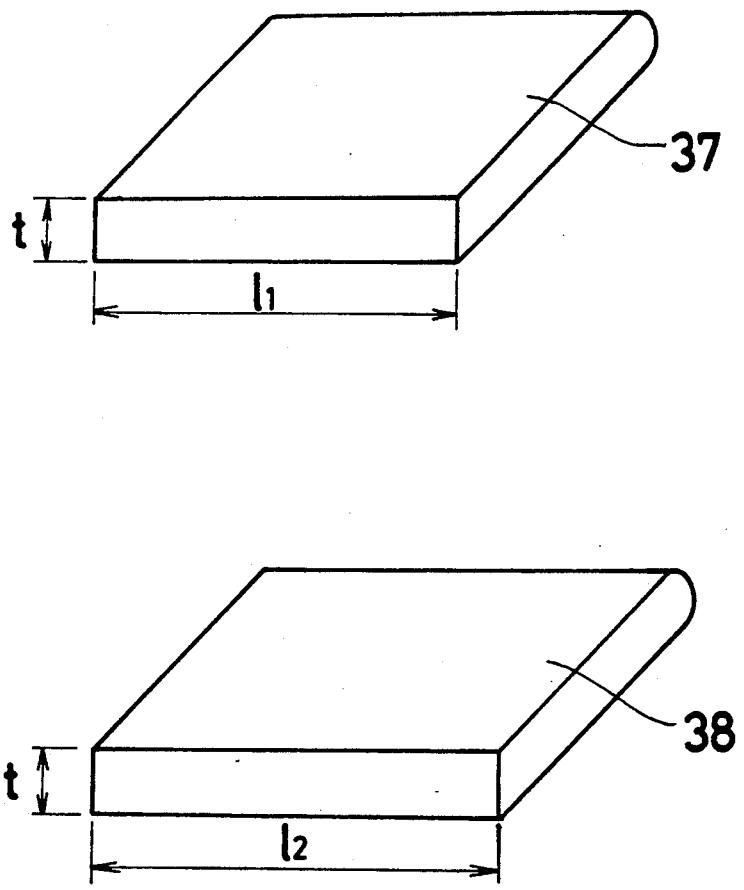
FIG. 5 is a view similar to FIG. 4, but showing first and second vanes which differ in width, i.e., the dimension taken parallel to the axis of rotation.

Referring to FIG. 5, there is shown a modified embodiment. The first vane 37 and the second vane 38 have the same thickness of t. The width $l_2$ of the second vane 38, or the dimension taken parallel to the axis of rotation of the vane 38, is set larger than the width $l_1$ of the first vane 37 by a given amount $\Delta s$.

As described thus far, in accordance with the present invention, the pressure-receiving area of the inner end surface of each first vane held by the first rotor forcing oil into the pressure chamber between the intermediate side plates is set smaller than the pressure-receiving area of the inner end surface of each second vane held by the second rotor. Therefore, the second vanes held by the second rotor come out always earlier than the first vanes held by the first rotor. Even at low temperatures where the viscosity of the working oil is large the first vanes are prevented from coming out earlier than the second vanes. Hence it is unlikely that the side plate opposite to the second rotor deflects excessively toward the second rotor to fully occupy the gap, thereby creating a seizure.

What is claimed is:

1. A tandem pump comprising:

a pump housing;

a first cam ring, an intermediate side plate, and a second cam ring disposed side by side in order and fitted in the pump housing, the first cam ring having a cam surface on the inside, the second cam ring having a cam surface on the inside, the intermediate side plate being split into plural portions;

a first rotor fitted in the first cam ring and rotatable to pump oil;

a plurality of first vanes which are held by the first rotor so as to be capable of sliding radially, one end of each first vane making a sliding contact with the cam surface of the first cam ring;

a second rotor fitted in the second cam ring;

a plurality of second vanes which are held by the second rotor so as to be capable of sliding radially, one end of each second vane making a sliding contact with the cam surface of the second cam ring; and pressure chambers formed between adjacent portions of the intermediate side plate; wherein an inner end surface of each first vane which receives pressure is made smaller in area than an inner end surface of each second vane which receives pressure so that a pumping action in the first cam ring always occurs later than a pumping action in the second cam ring when rotations of the first rotor and the second rotor are started, and wherein said tandem pump is provided with a passage to lead oil pumped by rotation of said first rotor to said pressure chambers.

2. The tandem pump of claim 1, wherein the thickness of each first vane, or the dimension in the rotational direction of the rotors, is smaller than the thickness of each second vane.

3. The tandem pump of claim 1, wherein the width of each first vane, or the dimension in a direction parallel to the axis of rotation of the rotors, is smaller than the width of each second vane.

4. A tandem pump comprising:

a pump housing;

a first cam ring, an intermediate side plate, and a second cam ring disposed side by side in order and fitted in the pump housing, the first cam ring having a cam surface on the inside, the second cam ring having a cam surface on the inside, the intermediate side plate being split into plural portions;

a first rotor fitted in the first cam ring and rotatable to pump oil;

a plurality of first vanes which are held by the first rotor so as to be capable of sliding radially, one end of each first vane making a sliding contact with the cam surface of the first cam ring;

a second rotor fitted in the second cam ring;

a plurality of second vanes which are held by the second rotor so as to be capable of sliding radially, one end of each second vane making a sliding contact with the cam surface of the second cam ring, wherein a thickness dimension of each first vane in the rotational direction of the rotors is smaller than a corresponding thickness of each second vane; and pressure chambers formed between adjacent portions of the intermediate side plate and receiving oil pumped by rotation of the first rotor.

* * * * *